US007174931B2

(12) United States Patent
Espinasse

(10) Patent No.: US 7,174,931 B2
(45) Date of Patent: Feb. 13, 2007

(54) LIQUEFIED GAS TRANSFER INSTALLATION AND USE THEREOF

(75) Inventor: Philippe Espinasse, Bihorel (FR)

(73) Assignee: Technip France (FR)

( * ) Notice: Subject to any disclaimer, the term of this patent is extended or adjusted under 35 U.S.C. 154(b) by 106 days.

(21) Appl. No.: 10/535,590

(22) PCT Filed: Nov. 6, 2003

(86) PCT No.: PCT/FR03/03324

§ 371 (c)(1),
(2), (4) Date: May 19, 2005

(87) PCT Pub. No.: WO2004/048191

PCT Pub. Date: Jun. 10, 2004

(65) Prior Publication Data

US 2006/0048850 A1 Mar. 9, 2006

(30) Foreign Application Priority Data

Nov. 19, 2002 (FR) ..... 02 14471

(51) Int. Cl.
*B65B 1/04* (2006.01)

(52) U.S. Cl. ..... 141/387; 441/4

(58) Field of Classification Search ..... 141/387, 141/388, 82; 114/231, 230.1, 230.13; 441/3–5
See application file for complete search history.

(56) References Cited

U.S. PATENT DOCUMENTS

| | | | | |
|---|---|---|---|---|
| 3,722,223 | A * | 3/1973 | Gratz | 405/219 |
| 3,984,059 | A | 10/1976 | Davies | 141/387 |
| 4,339,002 | A * | 7/1982 | Gibbs | 166/355 |
| 6,394,154 | B1 * | 5/2002 | Pollack | 141/387 |

FOREIGN PATENT DOCUMENTS

| | | |
|---|---|---|
| FR | 1206930 | 2/1960 |
| FR | 1318891 | 2/1963 |
| FR | 2815025 | 4/2002 |
| WO | WO 98/32651 | 7/1998 |

* cited by examiner

*Primary Examiner*—Steven O. Douglas
(74) *Attorney, Agent, or Firm*—Ostrolenk, Faber, Gerb & Soffen, LLP

(57) ABSTRACT

The invention concerns a liquefied gas transfer installation, in particular for liquefied natural gas, adapted to transfer liquefied gas between two surface tanks and distally spaced apart. The installation comprises a transfer line. The transfer line is immersed in water. The invention is applicable to installations for loading ships with natural gas.

18 Claims, 1 Drawing Sheet

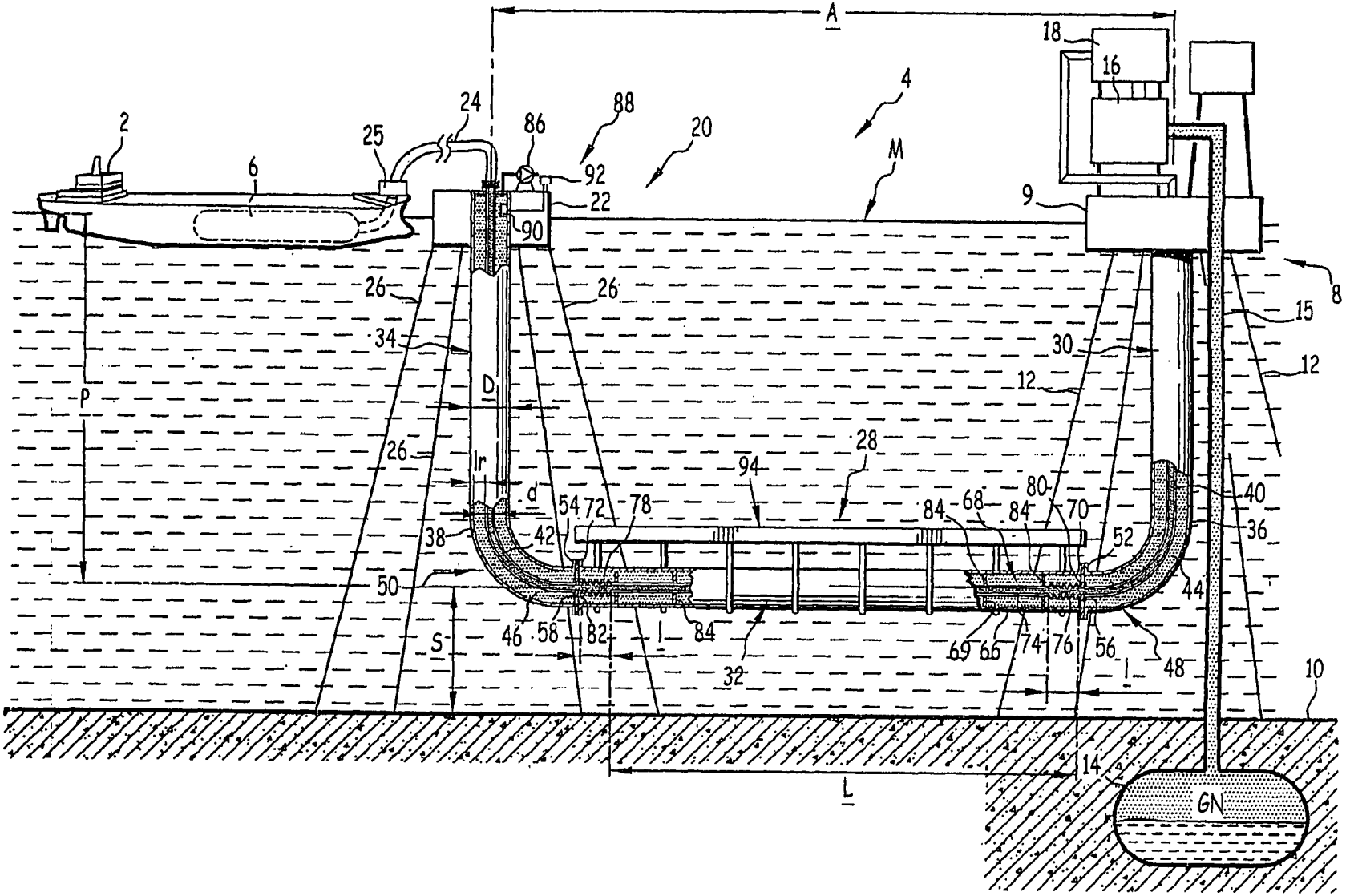
8
15
12
10
40
36
44
48
52
56
14
GN
16
18
9
30
12
70
80
84
68
76
74
66
69
4
M
28
A
L
94
32
20
88
92
22
26
78
72
54
42
82
58
46
86
90
d
D
r
24
38
S
25
34
26
50
6
2
P

LIQUEFIED GAS TRANSFER INSTALLATION AND USE THEREOF

CROSS REFERENCE TO RELATED APPLICATION

The present application is a 35 U.S.C. 371 national phase conversion of PCT/FR03/003324, filed Nov. 6, 2003, which claims priority of French Application No. 02/14471, filed Nov. 19, 2002. The PCT International Application was published in the French language.

BACKGROUND OF THE INVENTION

The present invention relates to an offshore installation for transferring a liquefied gas, especially liquefied natural gas, particularly from one tank to another tank via a submerged transfer line.

The present invention relates to an offshore installation for transferring a liquefied gas, especially liquefied natural gas, as described in the preamble of claim 1.

It applies especially to methods of filling transport ships with liquefied gas or liquefied natural gas (LNG tankers).

Methods of filling transport ships with natural gas and liquefied natural gas are known.

The known gas transport ships have tanks for transporting gas in the liquid state and, in certain cases (liquefied petroleum gas), they include a gas liquefaction installation.

To fill these ships with liquefied gas, the liquefaction installation is linked to a transfer line which is connected to a source of liquefied gas, for example an onshore or offshore storage tank.

Also known are methods of filling a ship with liquefied gas in which the gas is liquefied and stored in a temporary storage tank located, for example, on a production platform. The liquefied gas is then transferred onto the ship via a transfer installation.

Such a transfer installation is described in document FR-A-2 793 235. This transfer installation is composed of a plurality of articulated hose segments in the form of deformable lozenges, the ends of which are connected, on one side, to a connection system on the ship. and, on the other side, to a hose placed alongside a crane.

This installation has to meet significant mechanical constraints. It is placed near the production platform and must be able to adapt to the movements of the production platform (six degrees of freedom, including roll, pitch, heave, surge). In addition, the installation includes many rotary seals, which are in constant movement. Its maintenance is therefore relatively expensive. This type of installation is used for the loading and unloading of LNG tankers in ports of production terminals or those for receiving liquefied natural gas, alongside sheltered jetties.

Other liquefied gas transfer installations are known. These installations are used for transferring liquefied gas or liquefied natural gas (LNG) between two ships. Such installations mean that the two ships have to be positioned one behind the other or else side by side.

In both these configurations, the distance separating the ships is relatively small. The two ships have large and similar dimensions and are subjected to swell and to currents. Thus, each of them moves with six degrees of freedom and relatively independently of the other. The transfer installation is designed to take account of these relative movements of the two ships, which are also dependent on the weather conditions.

Another transfer installation, known for example from French Patent application FR-A-2 815 025, comprises a flexible transfer hose in a form of a catenary linking the storage installation to the transport ship. At rest, the flexible hose is stored on a gantry associated with a production and storage installation. The flexible hose is connected to the ship via a connection module fastened to or independent of this flexible hose.

Patent application WO 01/87703 proposes an installation for transfer from a production site to an LNG tanker. This installation is composed of an arm placed on the production site and extending over a length of 30 to 60% of the safety distance between the two ships. A flexible hose is wound onto a wheel at the end of the arm. This hose is connected to the LNG tanker during transfer.

Document WO 01/34460 proposes an overhead installation for transferring liquefied natural gas between two ships with a connection system mounted on the end of a flexible hose, which is connected to the installation of the second ship.

In all these known devices, the hoses used for transferring the gas have only a relatively short length (less than 100 meters) and lie above the surface of the sea. Consequently, the ship can be loaded only when it is close to the platform or the delivery ship, thereby creating risks of collision and making the transfer device very dependent on the weather conditions.

SUMMARY OF THE INVENTION

The object of the present invention is to alleviate the drawbacks mentioned and to propose an installation for transferring a liquefied gas that is inexpensive and is safe.

For this purpose, the subject of the invention is an installation of the aforementioned type having a transfer line with a rigid substantially horizontal main section jointed by vertical sections to the tanks and the main section being in a water layer region with low dynamic forces. The transfer line has an annular space containing thermal insulation.

According to other embodiments, the installation includes other features described below.

The subject of the invention is also the use of an installation as defined above for transferring a liquefied gas from a first tank to a second tank.

BRIEF DESCRIPTION OF THE DRAWING

A better understanding of the invention will be gained on reading the following description, given solely by way of example and with reference to the appended drawing, in which FIG. 1 is a schematic view of one embodiment of a transfer installation according to the invention, in partial cross section.

DESCRIPTION OF A PREFERRED EMBODIMENT

FIG. 1 shows an installation for filling a ship 2 with liquefied gas or liquefied natural gas, this installation being denoted by the general reference 4.

In what follows the expression "gas" will be used for any product or compound which, under ambient conditions (0.1013 MPa/20° C.) is in the gaseous state. The expression "liquid gas" will be used for such a product, which is at least partially in the liquid state, and the expression "gas in the gaseous state" will be used for any product in the gaseous state.

The ship 2 is a tanker, known per se, in which a liquid gas transfer tank 6 is installed.

In general, the ship 2 is a vessel designed to transport liquefied gas, and in particular an LNG tanker.

The installation 4 comprises a production unit (linked to or including a drilling unit comprising gas production wells) consisting for example of a production barge 9 or platform anchored or fastened to the seabed 10 by cables 12. The production unit is connected to a pocket 14 of natural gas in the gaseous state via a riser 15. This feeds a liquefaction device 16 with gas in the gaseous state, said device being supported by the barge 9. An outlet of the liquefaction device 16 runs into a temporary liquefied gas storage tank 18.

The installation 4 furthermore includes means 20 for transferring liquid gas from the storage tank 18 into the transport tank 6.

The means 20 for transferring gas to the transport tank 6 comprise a loading buoy 22 to which the tanker is connected for the loading operation. According to the invention, this loading buoy 22 is spaced remotely from the production barge 9. This configuration allows the tanker or LNG tanker to move and be moored independently of the barge 9, with no risk of collision.

Moreover, the connection between the loading buoy 22 and the transport tank 6 on the ship 2 is made via a loading hose 24.

The loading hose 24 lies entirely above the surface M of the sea. It has means 25 for temporary connection to the tank 6.

The tank 6 is filled with liquefied gas or liquefied natural gas (LNG) from the loading buoy 22 in order to transport this gas to land.

The loading hose 24 is known per se. It may consist either of rigid hose sections, linked together via rotary seals, or by a flexible hose. The loading hose 24 is supported by an appropriate support structure, such as a crane (not shown) or a floating structure designed accordingly.

The loading buoy 22 is anchored to the seabed 10 via cables and/or chains 26 and is spaced remotely from the production barge 9. The distance A between the loading buoy 22 and the production barge is greater than 300 m and will preferably be around one nautical mile (1.852 km).

The loading buoy 22 is small compared to the ship 2. The ship 2 is exposed to the swell, to the currents and to the weather conditions. It can swing freely about the loading buoy 22 while the liquefied gas or liquefied natural gas is being loaded.

The transfer means 20 also include a transfer line 28 submerged in the water, which links the storage tank 18 to the loading buoy 22.

The transfer line 28 is designed to transfer liquid gas from the production barge 9 to the loading buoy 22, while still being immersed in the water while the liquefied gas is being transferred. The barge 9 forms a first terminal of the transfer line 28 and the loading buoy 22 forms a second terminal of the transfer line 28.

The terminals, in this case the loading buoy 22 and the production barge 9, can move independently of each other in any direction over a distance that may be up to 10% of the water depth in deep seas and even more for depths of less than 150 m. The amplitude of the relative movement between the two terminals may therefore be more than 20% of the water depth.

The submerged transfer line 28 must therefore be capable of absorbing these distance variations between the two floating terminals 9 and 22.

Dynamic bending forces and vibrations are generated on the submerged part of the transfer line 28 by the swell movements, the sea currents and the relative movements of the terminals 9, 22.

The combination of these dynamic forces and vibrations results in substantial fatigue of the submerged part of the transfer line 28, thereby significantly reducing its lifetime.

Rigid hoses are very sensitive to these dynamic forces and to vibrations. This is why it is usually necessary to link the rigid hose to the terminals via various types of rotary seals or flexjoints so as to follow the movements of the terminals and to absorb to a greater or lesser extent the dynamic forces. In addition, the regions exposed to substantial vibrations must generally be equipped with additional specific means, such as helical antivibration fins.

Flexible hoses are known for their great strength and their ability to absorb these dynamic forces, but their cost is high.

These dynamic forces are in particular present in what is called the turbulence region. The turbulence region is a layer of water in which the effects of the swell and the currents are substantial. This region is defined as being the region in which the maximum speed of the water current is greater than a specified threshold. In general, this threshold is 1 m/s or even 0.5 m/s.

To give an example, in the case of Brazil (a region in which the speed of the currents is high), the turbulent region may descend down to a depth of 300 m, or even 500 m (15 to 25% of the water depth) in certain fields. In contrast, in West Africa (a region in which the turbulence is rather slight), this turbulence region may have a maximum depth of around 50 m (5% of the water depth).

The transfer line 28 according to the invention is a flexible/rigid hybrid line that combines the advantages of flexible hoses in the region subjected to high dynamic stresses with the low cost of rigid hoses in the regions where these dynamic stresses are limited.

The transfer line 28 therefore comprises a substantially horizontal rigid main section 32, which extends over a distance close to the distance A and is located in a region of the water layer in which the dynamic forces are low, and substantially vertical flexible sections 30 and 34 that link the ends of the main section 32 to the terminals 8, 22 and ensure continuity of the liquid gas transport and take up the dynamic forces.

The rigid main section 32 lies at a depth P relative to the surface of the sea. This depth P is greater than the depth of the turbulence region defined above, preferably more than 50 m.

The sections 30 and 34 are substantially identical and formed from a flexible external jacket 36, 38 with a circular cross-section of diameter D and from a flexible internal hose 40, 42 with a circular cross-section of diameter d. The jackets 36, 38 and the hoses 40, 42 are relatively flexible in bending. Each of the hoses 40, 42 is placed coaxially in the corresponding jacket 36, 38, forming an annular space 44, 46 of radial width lr. The cryogenic flexible hoses 40, 42 are known per se and comprise, radially from the inside outward, a corrugated tube, glass-fiber, reinforcement armors that are spiraled, for example at 55°, and one or more thermal insulation layers separated by impermeable layers.

The flexible external jacket may be formed from a conventional flexible hose known per se or from a corrugated sheath.

The double-jacket configuration allows the internal hose to be protected and the liquefied gas or liquefied natural gas to be confined in the event of a leak.

Each of the sections 30 and 34 terminates at its lower end in a double-flange fitting 52, 54 for coupling to the central section 32.

The lateral section 30 is fixed at its upper end to the production barge 9 while the section 34 is fixed at its upper end to the loading buoy 22. The lateral sections 30, 34 are thermally insulated.

The upper end of the hose 40 is joined to the storage tank 18 via a hose system 58 known per se.

The hose 42 of the section 34 is joined to the loading hose 24 via known connection means 59. These connection means 59 are designed to allow the ship 2 to move about the loading buoy 22.

The horizontal central section 32 is formed from a cylindrical rigid external jacket 66 with a diameter D and a horizontal axis, a rigid internal hose 68 with a diameter d being placed in the external jacket 66 leaving an annular space 69.

In other words, this section 32 forms a double-walled hose.

Since the relative density of the liquefied natural gas is 0.45, the exporting transfer line 28 may therefore have, depending on its diameter, a positive or a negative buoyancy.

The main section 32 may therefore be combined with a balancing body 94, so as to keep this section 32 at the required water depth and to ensure that it lies approximately horizontally.

If the buoyancy of the main section 32 is positive, the balancing body 94 may be a ballasting body. If the buoyancy is negative, the balancing body 94 may provide the main section 32 with buoyancy.

The main section 32 has a length L which is at least 50% of the distance A between the two terminals 8, 22 and which is preferably at least 90% of this distance.

The section 32 terminates at its two ends in two double-flange fittings 70, 72 complementary to those of the two double-flange fittings 52, 54.

It should be noted that all the double-flange fittings 52, 54, 70, 72 are designed to connect the hoses 40, 42, 38 and the jackets 36, 38, 66 in a liquid-tight and gas-tight manner.

Moreover, each of the double-flange fittings 52, 54, 70, 72 includes through-openings that connect the annular spaces 44, 46, 69 together, so as to ensure continuity of the thermal insulation in the annular space, over the entire length of the transfer line 28.

The hose 68 includes a rigid central part 74 of cylindrical shape with a diameter d, which part is fastened to the two sides of an axially deformable bellows 76, 78. Each bellows 76, 78 is fastened to one of the double-flange fittings 70, 72.

The bellows 76, 78 each have a length l which is sufficient to compensate for the thermal contraction along the axial direction of the central part 74 of the hose 68 over a temperature range lying between the water temperature and the temperature of the liquid gas that has to be transferred. The water temperature is generally between 4° C. and 20° C. In the case of loading the transport tank 6 with liquefied natural gas, the temperature of the liquid gas is between −150° C. and −180°. The bellows 76, 78 therefore have a sufficient length to compensate for the expansion of the central part 74 over a temperature range of around 200° C.

The central hose 68 is manufactured from a metal having a low thermal expansion coefficient. The expansion coefficient $\alpha$ is less than $16\times10^{-6}$ m/m per ° C. and preferably less than $2\times10^{-6}$ m/m per ° C. The central hose 68 is for example made of a material sold under the brand name INVAR (R) by Imphy and by Creusot-Loire. This material has an expansion coefficient $\alpha$ of $1.6\times10^{-6}$ m/m per OC at temperatures below −150° C.

For a distance A of 1 sea mile between the production barge 9 and the loading buoy 22, the contraction length l is about 2.5 m and preferably between 2 and 3 m.

The jacket 66 is made of standard steel, for example carbon steel, for subsea application.

Moreover, the central part 74 is centered radially with respect to the central jacket 66 by centering disks 84 or spacers that are placed in the annular space 69. These disks 84 are made of a material having a low thermal conductivity, for example polyurethane, polypropylene or polyamide.

The section 32 has to be thermally insulated. To do this, the annular space 69 present between the jacket 66 and the hose 68 will comprise a thermal insulation having a thermal conductivity of less than the thermal conductivity of air at atmospheric pressure.

The annular spaces 44, 46, 69 may be filled with thermal insulation material such as:

- plastic foams (made of polystyrene, polyvinyl or polyurethane resin);
- glass foam;
- powders (pearlite, alumina);
- superinsulators, which offer the best compromise for reducing the main heat flux. These are composed of a succession of reflecting screens (made of aluminum) between which are interposed intermediate sheets that have a low thermal conductivity (plastic films, glass fibers); or
- other materials that are microporous.

Moreover, to further improve the thermal insulation, the thermal insulation material may be placed partly under vacuum.

As a variant, the space 69 is under a pressure below atmospheric pressure, which may represent a vacuum of around 30 mbar abs. For this purpose, the installation 4 includes a vacuum pump 86 located on the loading buoy 22 or on the production barge 9 and linked with its suction side to the annular space 46 of the section 34 or to the annular space 44 of the section 30.

One of the advantages of the transfer line 28 according to the invention is that it has a continuous annular space over its entire length. This annular space makes it possible to confine any leaks inside the external jacket and increases the safety of the transfer line.

In addition, this continuous annular space makes it possible to ensure continuity of the thermal installation, for example by keeping this annular space under reduced pressure or under vacuum. Finally, it makes it possible to check the integrity of the exporting line (for sealing defects, etc.). To do this, the installation 4 may therefore include means 88 for detecting a gas leak in the hoses 40, 42, 68 or a sealing defect of one of the jackets 36, 38, 66.

These detection means 88 are formed by a sensor 90 for detecting pressure and/or pressure variation and/or natural gas, especially a $CH_4$, this sensor being placed in the space 46 or 44 and connected to a display device 92.

When the pressure or the pressure variation exceeds predetermined values, the sensor 90 delivers a warning signal to the display device 92.

Thus, a change in pressure in the space 46 will allow a sealing defect in the hoses 40, 42, 68 or the jackets 36, 38, 66 to be detected.

As an alternative, the annular spaces 44, 46, 69 may be filled with an inert gas, for example nitrogen, as thermal insulation (preferably at a pressure below atmospheric pressure). This gas allows the atmosphere of the annular space to be controlled and to ensure that there is no oxygen therein, thereby reducing the risks of corrosion. In addition, a gas leak or a sealing defect can then be detected by measuring the pressure in the interstice 46 or by measuring the content of the inert gas.

The installation according to the invention operates as follows.

The production unit 8 produces gas in the "gaseous" state, which is liquefied by the liquefaction device 16 and is stored in the storage tank 18.

The ship 2, with the empty transport tank 6 approaches the charging buoy 22, and the transport tank 6 is connected to the hose 42 of the section 34 via the loading hose 24.

The liquefied gas is conveyed from the storage tank 18 via the hoses 24, 40, 42, 68 to the transport tank 6.

Given that the gas flows through the hoses in the liquid state, a substantial mass flow rate of gas in the liquid state is obtained for a given pressure and a given cross-section of the hose. The operation of filling the transport tank 6 is then carried out rapidly. The order of magnitude of the filling time according to this method is around 12 hours.

The fact that the transfer line 28 is submerged in the water allows the loading buoy 22 to be connected to the production barge 9 over great distances. The tanker 2 is therefore loaded at a large distance A, with no risk of collision between the tanker or LNG tanker and the production barge 9.

The transfer line 28 according to the invention also allows the liquid gas to be rapidly discharged from the transport tank 6 to a storage tank (not shown).

As a variant, the transfer line 28 may comprise a bundle of hoses arranged so as to be mutually parallel. In particular, this bundle of hoses may include one or more hoses for returning gas in the gaseous state, which gas will flow from the transport tank 6 back to the storage tank 18, and one or more hoses for transporting the liquid gas, and a balancing body for the main section 32.

Also as a variant, each of the ends of the main section 32 may be linked to the corresponding terminal 8, 22 by means of a mooring line (not shown) mounted in parallel with the lateral sections 30, 34.

Each mooring line has a length of less than the length of the lateral sections 30, 34 so that the lateral sections 30, 34 are not subjected to the tensile force generated by the main section 32. The mooring line consists of a chain or cable made of carbon fiber, a steel cable or a polypropylene rope. In this case, the section 32 will be slightly weighty or the mooring lines will be tensioned by counterweights placed at the ends of the main section 32.

In another alternative, the main section 32 may be anchored directly to the seabed via mooring lines. In this case, the main section 32 will be slightly buoyant or the mooring lines will be tensioned by buoys located at the ends of the main section 32.

According to another variant, the sections 30, 34 each comprise an internal hose of the corrugated type and an external jacket of the corrugated type. The hose and the jacket are manufactured from stainless steel or INVAR (R). In addition, reinforcement armors are wound around the internal hose, preferably over its entire length.

The thermal insulation layer of these sections is composed, depending on the length of the sections, of a succession of rigid centering disks formed from two assembled half-shells and from flexible rings.

The centering disks are fixed to the internal hose and are manufactured from a rigid microporous aerogel material. The flexible rings are formed from several layers of flexible microporous aerogel material.

The invention claimed is:

1. An offshore installation for transferring a liquefied gas, the installation comprises:

a first tank and a second tank for transfer of liquefied gas from the first tank to the second tank the second tank is on a surface and not submerged in water, a transfer line connectable to first and second tanks the first and second tanks being apart during transfer of the liquefied gas, the transfer line being submerged in water;

a first thermal carrying the first tank and a second terminal apart from the first terminal, the transfer line extends between the first and second terminals, the first tank is on the surface;

the transfer line comprises a substantially horizontal rigid main section located in a region of the water layer in which the dynamic forces are low the main section having ends;

substantially vertical flexible sections which link the ends of the main section to the first and second terminals for continuity of liquid gas transport and take up of dynamic forces, the main section and the flexible sections comprise an internal transport hose for transfer of the liquefied gas and an external jacket around the transport hose which define an annular space between the hose and the jacket and that extends over the entire length of the transfer line, thermal insulation in the annular space for thermally insulating the space and a filling device for filling the annular space with inert gas.

2. The installation as claimed in claim 1, wherein the rigid main section comprises a bundle of parallel hoses.

3. The installation as claimed in claim 2, wherein the bundle of hoses includes a return hose for return flow of the gas in the gaseous state flow from the second tank back to the first tank.

4. The installation as claimed in claim 1, further comprising a verification device operable to check the sealing of at least one of the jacket and the hose.

5. The installation as claimed in claim 4, wherein the verification device comprises a sensor operable for detecting a pressure variation within the annular space and suitable operable for delivering a warning signal when a pressure variation in the space lies about a predetermined value.

6. The installation as claimed in claim 4, wherein the verification device comprises a sensor operable for detecting the presence in the annular space of at least one of the components of the liquefied gas that is conveyed by the hose and the amount of inert gas in the annular space.

7. The installation as claimed in claim 1, wherein the rigid main section is adapted to be used in and to be located in a region of the water layer in which the maximum speed of the water current is below 1 m/s.

8. The installation as claimed in claim 1, wherein the first and the second tanks are spaced apart by a distance greater than 300 meters during transfer of the liquefied gas.

9. The installation as claimed in claim 1, wherein the second terminal links the transfer line to a loading hose equipped with means for connection to the second tank which is carried by a ship.

10. The installation as claimed in claim 1, further comprising an evacuation device connected to the annular space, the evacuation device being operable designed to keep the space at a pressure below atmospheric pressure.

11. The installation as claimed in claim 1, wherein the internal hose of the main section comprises a rigid metal part having ends and a compensating bellows at least one of the ends, the bellows permitting variation in length of at least a variation in length of the rigid metal part under a variation in temperature between the water temperature at the rigid part and the temperature of the liquefied gas in the rigid part.

12. The installation as claimed in claim 1, further comprising a balancing body from which the rigid main section is suspended and the balancing body that is operable to provide the main section with buoyancy or with ballast.

13. The installation as claimed in claim 1, wherein the rigid main section is suspended from the first and second terminals.

14. The installation of claim 1, wherein the second terminal is a loading buoy.

15. The installation of claim 8,wherein the first and second tanks are spaced apart by a distance of the order of one nautical mile.

16. The installation of claim 10, wherein the pressure is below 100 mbar.

17. The installation of claim 10, wherein the pressure is approximately 30 mbar.

18. The installation of claim 1, wherein the rigid main section is anchored on the seabed by a mooring line.

* * * * *